US007032544B2

(12) United States Patent
Kuo et al.

(10) Patent No.: US 7,032,544 B2
(45) Date of Patent: Apr. 25, 2006

(54) HOT WATER AND STEAM GENERATOR

(76) Inventors: Chin-Liang Kuo, 8F-1, No. 110, Sanduo 4th Rd., Kaohsiung City (TW); Chun-Lin Lin, 8F-1, No. 110, Sanduo 4th Rd., Kaohsiung City (TW); Hui-Tuan Tsai, 8F-1, No. 110, Sanduo 4th Rd., Kaohsiung City (TW)

( * ) Notice: Subject to any disclaimer, the term of this patent is extended or adjusted under 35 U.S.C. 154(b) by 0 days.

(21) Appl. No.: 10/945,391

(22) Filed: Sep. 20, 2004

(65) Prior Publication Data

US 2006/0060156 A1 Mar. 23, 2006

(51) Int. Cl.
*F22B 3/06* (2006.01)

(52) U.S. Cl. ..... 122/26; 237/12.3 R

(58) Field of Classification Search ..... 122/26; 126/247; 237/12.3 R
See application file for complete search history.

(56) References Cited

U.S. PATENT DOCUMENTS

| | | | | |
|---|---|---|---|---|
| 2,090,873 | A * | 8/1937 | Lasarus | 126/247 |
| 4,256,085 | A * | 3/1981 | Line | 126/247 |
| 5,419,306 | A * | 5/1995 | Huffman | 126/247 |
| 6,596,178 | B1 * | 7/2003 | Archibald et al. | 210/774 |
| 6,910,448 | B1 * | 6/2005 | Thoma | 122/26 |

* cited by examiner

*Primary Examiner*—Gregory Wilson
(74) *Attorney, Agent, or Firm*—Alan D. Kamrath; Nikolai & Mersereau, P.A.

(57) ABSTRACT

A hot water and steam generator includes a base, a first seal plate mounted on the base, a container mounted on a side of the first seal plate, a second seal plate mounted on the base, a mounting ring mounted between and sealed by the first seal plate and the second seal plate, and a rotation wheel rotatably mounted in the mounting ring. Thus, the hot water and steam generator increases the water temperature rapidly due to collision and friction of water molecules by rotation of the rotation wheel so as to produce hot water and steam easily, rapidly and conveniently.

17 Claims, 5 Drawing Sheets

HOT WATER AND STEAM GENERATOR

BACKGROUND OF THE INVENTION

1. Field of the Invention

The present invention relates to a generator, and more particularly to a hot water and steam generator that can produce both of the hot water and the steam, thereby enhancing the versatility of the hot water and steam generator.

2. Description of the Related Art

A conventional heater is used to heat the water to produce a hot water, and a conventional vaporizer is used to vaporize the water into a steam or vapor so as to produce the steam. However, the heater and the vaporizer cannot be combined to produce the hot water and steam by the same machine, thereby limiting the versatility of the conventional heater and vaporizer.

SUMMARY OF THE INVENTION

The primary objective of the present invention is to provide a hot water and steam generator that increases the water temperature rapidly due to collision and friction of water molecules by rotation of the rotation wheel so as to produce hot water and steam easily, rapidly and conveniently.

Another objective of the present invention is to provide a hot water and steam generator that can produce both of the hot water and the steam, thereby enhancing the versatility of the hot water and steam generator.

A further objective of the present invention is to provide a hot water and steam generator, wherein the rotation wheel consists of the thin inner plate, the thin outer plate and the conducting tubes, so that the rotation wheel has a lighter weight, thereby decreasing rotation torque of the rotation shaft.

Further benefits and advantages of the present invention will become apparent after a careful reading of the detailed description with appropriate reference to the accompanying drawings.

DETAILED DESCRIPTION OF THE INVENTION

Figure 1:
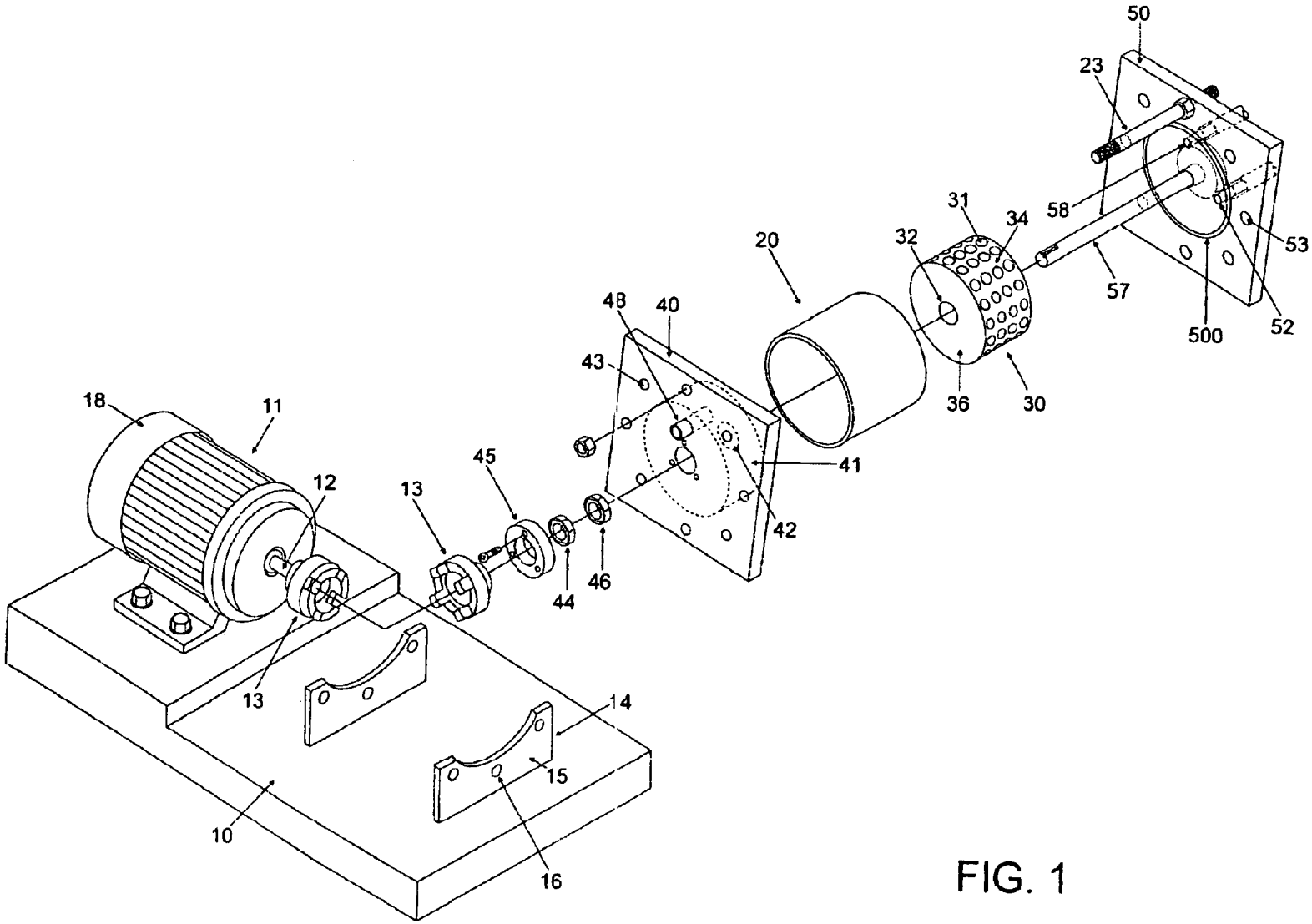
FIG. 1 is an exploded perspective view of a hot water and steam generator in accordance with the preferred embodiment of the present invention.
Figure 2:
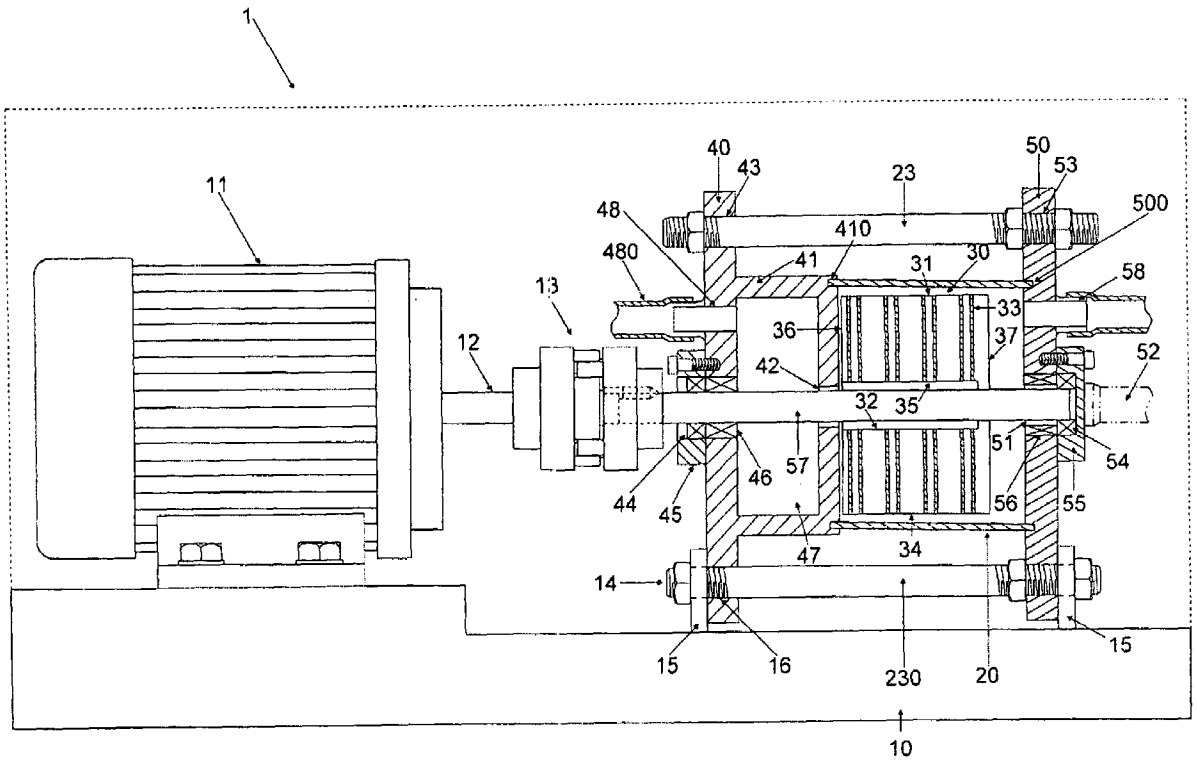
FIG. 2 is a front plan cross-sectional assembly view of the hot water and steam generator as shown in FIG. 1.
Figure 3:
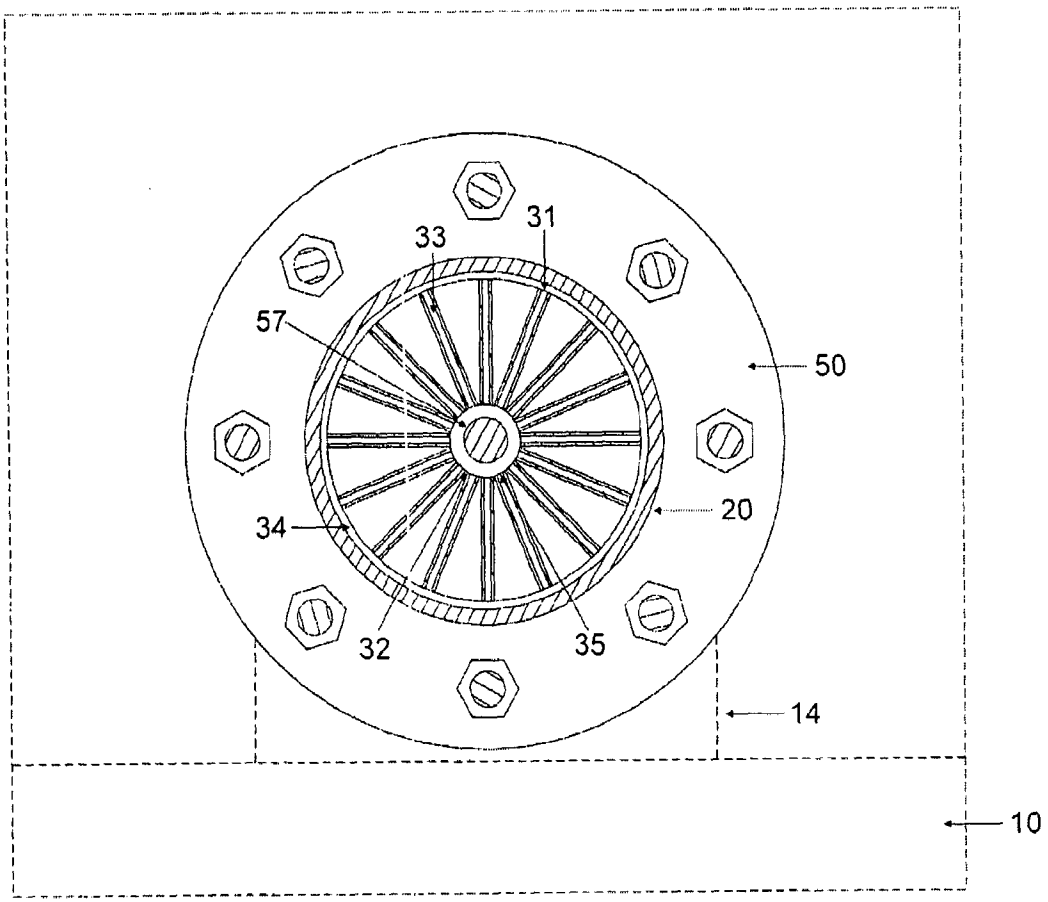
FIG. 3 is a side plan cross-sectional assembly view of the hot water and steam generator as shown in FIG. 1.

Referring to the drawings and initially to FIGS. 1–3, a hot water and steam generator 1 in accordance with the preferred embodiment of the present invention comprises a base 10, a first seal plate 40 mounted on the base 10, a container 41 mounted on a side of the first seal plate 40, a second seal plate 50 mounted on the base 10, a mounting ring 20 mounted between and sealed by the first seal plate 40 and the second seal plate 50, a rotation wheel 30 rotatably mounted in the mounting ring 20, and a power device 11 mounted on the base 10 for rotating the rotation wheel 30.

The first seal plate 40 is formed with a water inlet 48 connected to a water inlet pipe 480 (see FIG. 2). The first seal plate 40 has a periphery formed with a plurality of positioning holes 43.

The container 41 has an inside formed with a receiving space 47 (see FIG. 2) connected to the water inlet 48 of the first seal plate 40 and a side wall formed with a through hole 42 connected to the receiving space 47. The container 41 has a periphery formed with an annular positioning groove 410 mounted on a first end of the mounting ring 20.

The second seal plate 50 has a periphery formed with an annular positioning groove 500 mounted on a second end of the mounting ring 20. The second seal plate 50 is formed with a hot water outlet 52 and a steam outlet 58 located above the hot water outlet 52. The second seal plate 50 has a periphery formed with a plurality of positioning holes 53.

The hot water and steam generator 1 further comprises a plurality of positioning bolts 23 each extended through a respective one of the positioning holes 43 of the first seal plate 40 and a respective one of the positioning holes 53 of the second seal plate 50, so that the first seal plate 40 and the second seal plate 50 are combined with each other by the positioning bolts 23.

The hot water and steam generator 1 further comprises a positioning device 14 including two positioning plates 15 mounted on the base 10 for supporting the first seal plate 40 and the second seal plate 50 and each formed with a plurality of through holes 16, and a plurality of locking bolts 230 each extended through a respective one of the through holes 16 of each of the positioning plates 15, a respective one of the positioning holes 43 of the first seal plate 40 and a respective one of the positioning holes 53 of the second seal plate 50, so that the first seal plate 40 and the second seal plate 50 are fixed on the positioning plates 15 by the locking bolts 230.

The rotation wheel 30 includes a cylindrical inner plate 32 formed with a plurality of guide holes 35 each connected to the through hole 42 of the container 41, a cylindrical outer plate 34 mounted on the inner plate 32 and formed with a plurality of impact holes 31 each directed toward an inner wall of the mounting ring 20, and a plurality of conducting tubes 33 each mounted between the inner plate 32 and the outer plate 34 to support the inner plate 32 and the outer plate 34 and each having a first end connected to a respective one of the guide holes 35 of the inner plate 32 and a second end connected to a respective one of the impact holes 31 of the outer plate 34.

A cylindrical first cover plate 36 is mounted on a first end of the rotation wheel 30 and has an inner diameter equal to that of the inner plate 32 of the rotation wheel 30, and a cylindrical second cover plate 37 (see FIG. 2) is mounted on a second end of the rotation wheel 30, so that the rotation wheel 30 is sealed by the first cover plate 36 and the second cover plate 37. The first cover plate 36 is spaced from the container 41.

The power device 11 includes a rotation shaft 57 secured in the rotation wheel 30 for rotating the rotation wheel 30 and having a first end extended through the through hole 42 of the container 41 and the first seal plate 40 and a second end extended through the second seal plate 50, a bearing 46 rotatably mounted between the first end of the rotation shaft 57 and the first seal plate 40, a bearing 56 rotatably mounted between the second end of the rotation shaft 57 and the second seal plate 50, a drive motor 18 mounted on the base 10 and having a drive shaft 12, and a coupling device 13 mounted between the drive shaft 12 of the drive motor 18 and the first end of the rotation shaft 57, so that the rotation shaft 57 is rotated by the drive shaft 12 of the drive motor 18. The rotation shaft 57 is extended through the inner plate 32 of the rotation wheel 30, and the second cover plate 37 of the rotation wheel 30 is fixed on the rotation shaft 57 by soldering, so that the rotation wheel 30 is fixed on the rotation shaft 57 to rotate therewith. The inner plate 32 of the rotation wheel 30 has an inner diameter greater than the diameter of the rotation shaft 57.

A bushing 45 is mounted on the first seal plate 40, and a bearing 44 is rotatably mounted between the bushing 45 and the first end of the rotation wheel 30. A bushing 55 is mounted on the second seal plate 50, and a bearing 54 is rotatably mounted between the bushing 55 and the second end of the rotation wheel 30.

In operation, the rotation shaft 57 is rotated by the drive shaft 12 of the drive motor 18 to rotate the rotation wheel 30, so that the rotation wheel 30 is rotated in the mounting ring 20. Then, the water from the water inlet pipe 480 flows through the water inlet 48 of the first seal plate 40 into the receiving space 47 of the container 41 and then flows through the through hole 42 of the container 41 into the mounting ring 20 and the rotation wheel 30. At this time, the first cover plate 36 is spaced from the container 41, and the inner plate 32 of the rotation wheel 30 has an inner diameter greater than the diameter of the rotation shaft 57, so that the water is introduced into the inner plate 32 of the rotation wheel 30 and is stopped by the second cover plate 37. Then, the water is guided through the guide holes 35 of the inner plate 32, the conducting tubes 33 of the rotation wheel 30 and the impact holes 31 of the outer plate 34 and is directed toward the inner wall of the mounting ring 20. At this time, the rotation wheel 30 is rotated at a high speed to produce a centrifugal force on the water, so that the water hits, rubs and impacts the wall of the conducting tubes 33 of the rotation wheel 30 severely so as to increase the temperature of the water rapidly by the greater heat conduction of the rotation wheel 30 which is made of metallic material. After the water leaves the rotation wheel 30, the heated water is injected outward from the impact holes 31 of the outer plate 34 and is forced to hit, rub and impact the inner wall of the mounting ring 20 severely so as to further increase the temperature of the heated water rapidly, thereby producing hot water or steam.

In test, assuming the water temperature is about 20° C. to 25° C. when the water enters the rotation wheel 30, the temperature of the heated water that is rotated by the rotation wheel 30 and impacted rapidly by the impact holes 31 of the outer plate 34 during a period of time, about 90 seconds, is lifted to 58° C. to 63° C. Then, the hot water is drained outward from the hot water outlet 52 of the second seal plate 50.

In addition, when the rotation wheel 30 is rotated at a higher speed, the water is impacted more rapidly by the impact holes 31 of the outer plate 34 of the rotation wheel 30 to further increase the temperature of the heated water until the water is turned into the steam. Then, the steam is drained outward from the steam outlet 58 of the second seal plate 50.

Accordingly, the hot water and steam generator increases the water temperature rapidly due to collision and friction of water molecules by rotation of the rotation wheel 30 so as to produce hot water and steam easily, rapidly and conveniently. In addition, the hot water and steam generator can produce both of the hot water and the steam, thereby enhancing the versatility of the hot water and steam generator. Further, the rotation wheel 30 consists of the thin inner plate 32, the thin outer plate 34 and the conducting tubes 33, so that the rotation wheel 30 has a lighter weight, thereby decreasing rotation torque of the rotation shaft 57.

Figure 4:
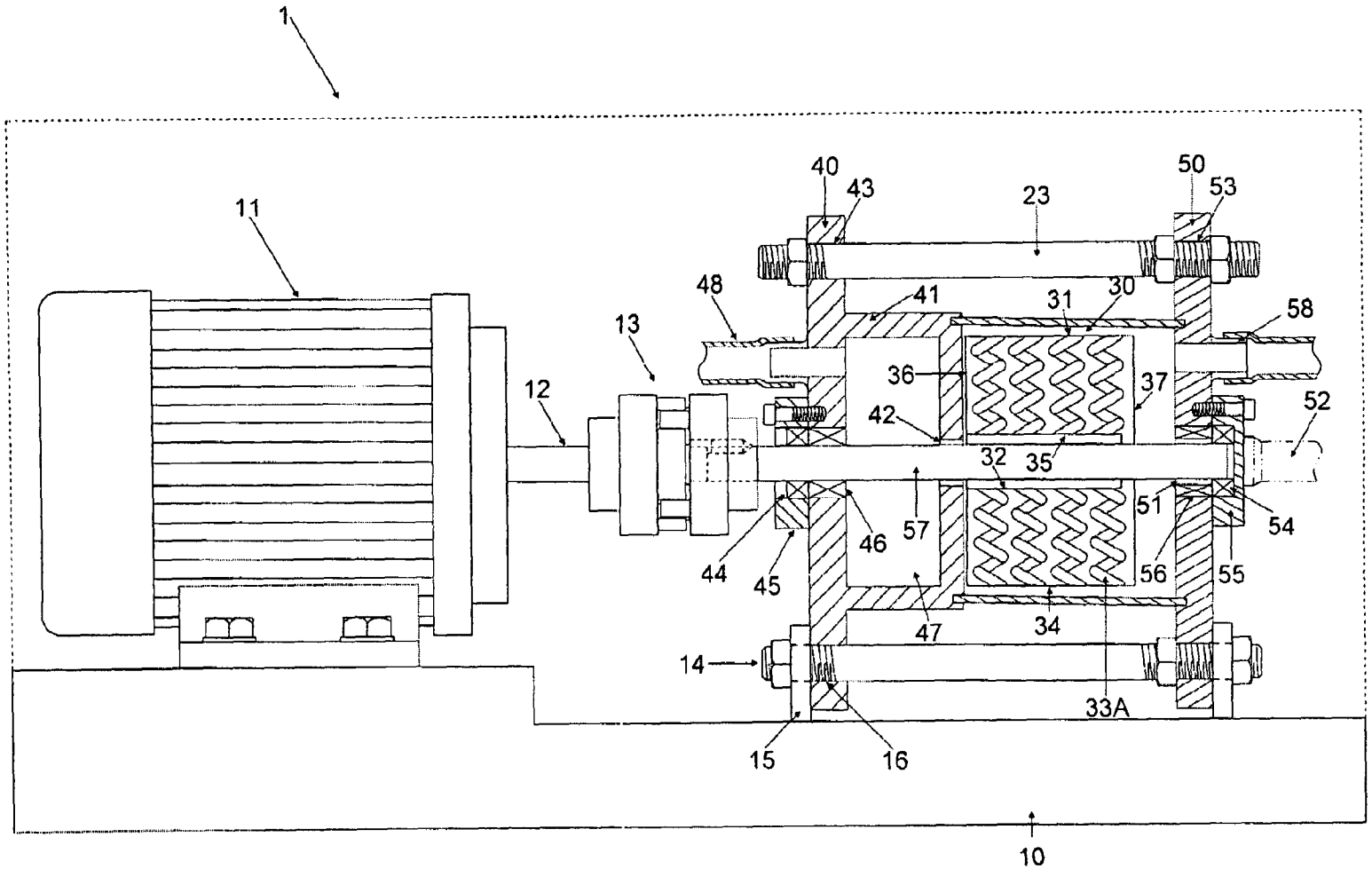
FIG. 4 is a front plan cross-sectional assembly view of a hot water and steam generator in accordance with another embodiment of the present invention.

Referring to FIG. 4, each of the conducting tubes 33A has a helical shape.

Figure 5:
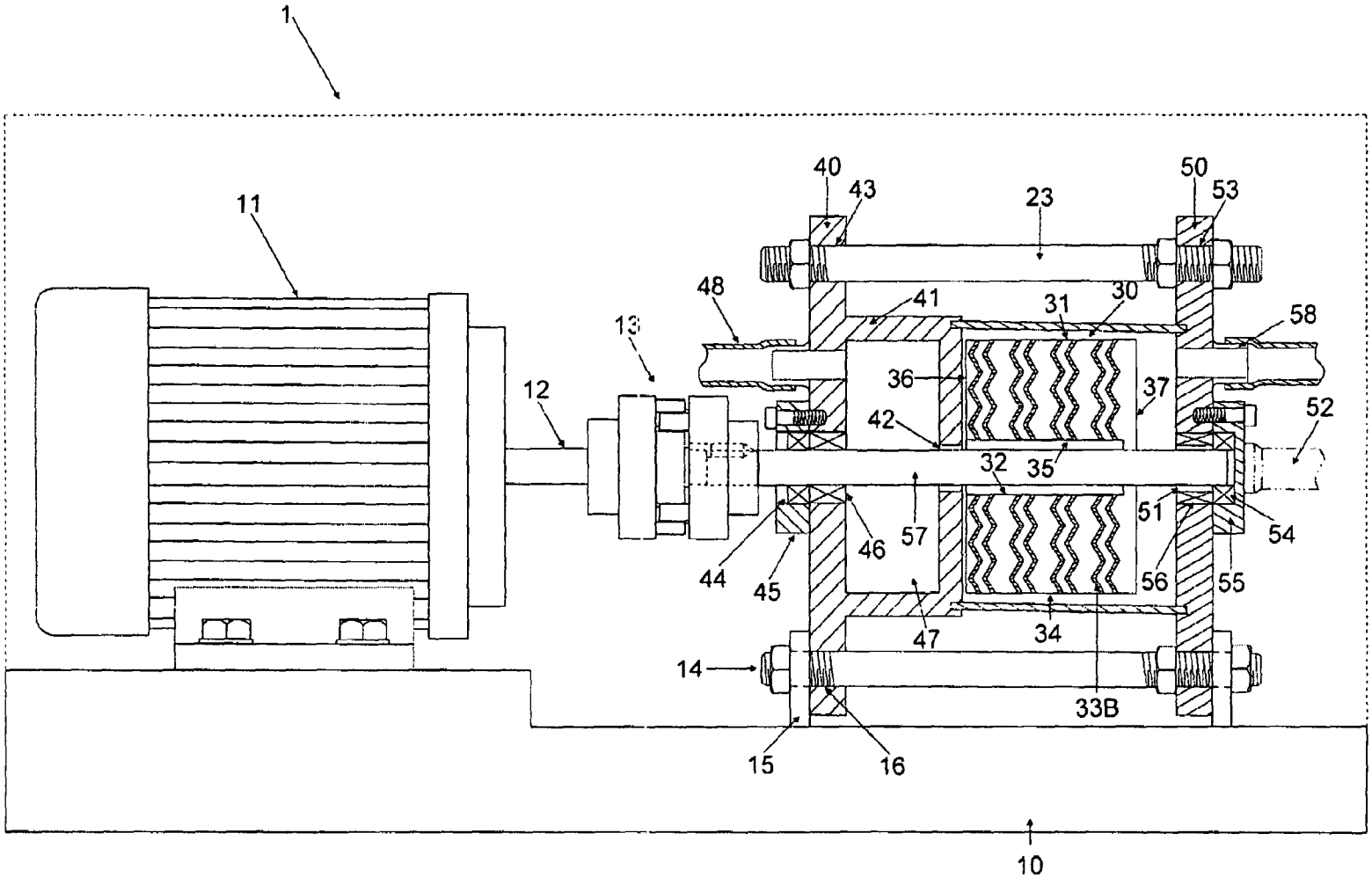
FIG. 5 is a front plan cross-sectional assembly view of a hot water and steam generator in accordance with another embodiment of the present invention.

Referring to FIG. 5, each of the conducting tubes 33B has a corrugated shape.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A hot water and steam generator, comprising:
a base;
a first seal plate mounted on the base;
a container mounted on a side of the first seal plate;
a second seal plate mounted on the base;
a mounting ring mounted between and sealed by the first seal plate and the second seal plate; and
a rotation wheel rotatably mounted in the mounting ring, wherein the rotation wheel includes a cylindrical inner plate formed with a plurality of guide holes each connected to the container, a cylindrical outer plate mounted on the inner plate and formed with a plurality of impact holes each directed toward an inner wall of the mounting ring, and a plurality of conducting tubes each mounted between the inner plate and the outer plate to support the inner plate and the outer plate and each having a first end connected to a respective one of the guide holes of the inner plate and a second end connected to a respective one of the impact holes of the outer plate.

2. The hot water and steam generator in accordance with claim 1, wherein the first seal plate is formed with a water inlet, the container has an inside formed with a receiving space connected to the water inlet of the first seal plate and a side wall formed with a through hole connected to the receiving space, and each of the guide holes of the inner plate is connected to the through hole of the container.

3. The hot water and steam generator in accordance with claim 1, further comprising a cylindrical first cover plate mounted on a first end of the rotation wheel, and a cylindrical second cover plate mounted on a second end of the rotation wheel, so that the rotation wheel is sealed by the first cover plate and the second cover plate.

4. The hot water and steam generator in accordance with claim 3, wherein the first cover plate has an inner diameter equal to that of the inner plate of the rotation wheel.

5. The hot water and steam generator in accordance with claim 3, wherein the first cover plate is spaced from the container.

6. The hot water and steam generator in accordance with claim 3, wherein the second cover plate of the rotation wheel is fixed on a rotation shaft, so that the rotation wheel is fixed on the rotation shaft to rotate therewith.

7. The hot water and steam generator in accordance with claim 1, further comprising a power device mounted on the base for rotating the rotation wheel and including a rotation shaft secured in the rotation wheel for rotating the rotation wheel and having a first end extended through the container and the first seal plate and a second end extended through the second seal plate, a drive motor mounted on the base and having a drive shaft, and a coupling device mounted between the drive shaft of the drive motor and the first end of the rotation shaft, so that the rotation shaft is rotated by the drive shaft of the drive motor.

8. The hot water and steam generator in accordance with claim 7, wherein the rotation shaft is extended through the inner plate of the rotation wheel, and the inner plate of the rotation wheel has an inner diameter greater than the diameter of the rotation shaft.

9. The hot water and steam generator in accordance with claim 7, wherein the power device further includes a bearing rotatably mounted between the first end of the rotation shaft and the first seal plate.

10. The hot water and steam generator in accordance with claim 7, wherein the power device further includes a bearing rotatably mounted between the second end of the rotation shaft and the second seal plate.

11. The hot water and steam generator in accordance with claim 7, wherein the power device further includes a bushing mounted on the first seal plate, and a bearing is rotatably mounted between the bushing and the first end of the rotation wheel.

12. The hot water and steam generator in accordance with claim 7, wherein the power device further includes a bushing mounted on the second seal plate, and a bearing is rotatably mounted between the bushing and the second end of the rotation wheel.

13. The hot water and steam generator in accordance with claim 1, wherein the second seal plate is formed with a hot water outlet and a steam outlet located above the hot water outlet.

14. The hot water and steam generator in accordance with claim 1, wherein each of the conducting tubes has a helical shape.

15. The hot water and steam generator in accordance with claim 1, wherein each of the conducting tubes has a corrugated shape.

16. A hot water and steam generator, comprising:

a base;

a first seal plate mounted on the base;

a container mounted on a side of the first seal plate;

a second seal plate mounted on the base;

a mounting ring mounted between and sealed by the first seal plate and the second seal plate;

a rotation wheel rotatable mounted in the mounting ring, wherein the first seal plate has a periphery formed with a plurality of positioning holes, the second seal plate has a periphery formed with a plurality of positioning holes, and the hot water and steam generator further comprises a plurality of positioning bolts each extended through a respective one of the positioning holes of the first seal plate and a respective one of the positioning holes of the second seal plate, so that the first seal plate and the second seal plate are combined with each other by the positioning bolts; and a positioning device including two positioning plates mounted on the base for supporting the first seal plate and the second seal late and each formed with a plurality of through holes, and a plurality of locking bolts each extended through a respective one of the through holes of each of the positioning plates, a respective one of the positioning holes of the first seal plate and a respective one of the positioning holes of the second seal plate, so that the first seal plate and the second seal plate are fixed on the positioning plates by the locking bolts.

17. A hot water and steam generator, comprising:

a base;

a first seal plate mounted on the base;

a container mounted on a side of the first seal plate;

a second seal plate mounted on the base;

a mounting ring mounted between and sealed by the first seal plate and the second seal plate; and a rotation wheel rotatably mounted in the mounting ring, wherein the container has a periphery formed with an annular positioning groove mounted on a first end of the mounting ring, and the second seal plate has a periphery formed with an annular positioning groove mounted on a second end of the mounting ring.

* * * * *